US005088151A

United States Patent [19]

Legatt

[11] Patent Number: 5,088,151

[45] Date of Patent: Feb. 18, 1992

[54] COLLECTION SYSTEM FOR A FLOOR POLISHING MACHINE

[75] Inventor: Donald J. Legatt, St. Michael, Minn.

[73] Assignee: Advance Machine Company, Plymouth, Minn.

[21] Appl. No.: 764,977

[22] Filed: Sep. 23, 1991

Related U.S. Application Data

[63] Continuation of Ser. No. 691,457, Apr. 25, 1991, abandoned.

[51] Int. Cl.[5] ..... A47L 11/20

[52] U.S. Cl. ..... 15/385; 15/98

[58] Field of Search ..... 15/98, 383, 385

[56] References Cited

U.S. PATENT DOCUMENTS

| | | | |
|---|---|---|---|
| 1,093,820 | 4/1914 | Beach . | |
| 2,663,893 | 12/1953 | Percy . | |
| 2,933,752 | 4/1960 | McLennon . | |
| 2,957,295 | 10/1960 | Brown . | |
| 3,049,853 | 8/1962 | Horner et al. . | |
| 3,064,292 | 11/1962 | Fillery . | |
| 3,157,015 | 11/1964 | Russell et al. . | |
| 3,413,783 | 12/1968 | Gordon . | |
| 3,453,812 | 7/1969 | Heidner et al. . | |
| 3,568,421 | 3/1971 | Smith et al. . | |
| 4,148,110 | 4/1979 | Moen . | |
| 4,178,654 | 12/1979 | Mitchell . | |
| 4,598,440 | 7/1986 | Wilson | 15/385 |
| 4,701,976 | 10/1987 | Palmer et al. | 15/385 |
| 4,720,886 | 1/1988 | McLeod et al. . | |
| 4,731,895 | 3/1988 | Zack et al. . | |
| 4,731,956 | 3/1988 | Wood | 15/385 X |
| 4,805,258 | 2/1989 | Sitarski et al. | 15/385 |

FOREIGN PATENT DOCUMENTS

| | | | |
|---|---|---|---|
| 723168 | 1/1932 | France | 15/385 |

OTHER PUBLICATIONS

Hako ®Minuteman ® Manual 986711 Dated 2/88 (pp. 8-9, Back/Front).

Hako ®Minuteman ® Advertisement 986712 Copyright 1987.

*Primary Examiner*—Chris K. Moore

*Attorney, Agent, or Firm*—Peterson, Wicks, Nemer & Kamrath

[57] ABSTRACT

A dust collection/control system is disclosed utilized in a floor polishing machine (10) according to the most preferred form of the present invention. The floor polishing machine (10) includes a rotating working member in the form of a polishing member (16) for maintaining a floor surface as it is moved along the floor. The polishing member (16) is located and rotated within a housing or shield (186) including a circular, planar portion (92) terminating at its periphery in a downwardly extending flange (94) including a flexible skirt (95) which engages the floor. The rotation of the polishing member (16) within the housing (186) passively generates an air current contained within the housing (186). The air current engages first and second air barriers (190) which extend downwardly from the planar portion (92) and generally radially inwardly from the flange (94) to create a high pressure area upstream of the air barriers (190) with high pressure air being allowed to escape through an air outlet (188) into a filter and collection bag (148) and to create a vacuum downstream of the air barriers (190) to draw air around the skirt (95) to entrain the dust and air in the circling air current.

20 Claims, 1 Drawing Sheet

COLLECTION SYSTEM FOR A FLOOR POLISHING MACHINE

This is a continuation of copending application(s) Ser. No. 07/691,457 filed Apr. 25, 1991 now abandoned.

BACKGROUND

The present invention relates to apparatus for cleaning, particularly to apparatus for cleaning floor surfaces, and specifically to a unique and novel dust collection system for a floor polishing machine.

High speed burnishing is a floor polishing method using a very fine abrasive disc rotating at 1000 RPM's or more to produce a high "wet look" glass appearance on the floor. Typically a high solids content floor finish material is spread in a thin layer on the floor, allowed to harden, and then burnished with a high RPM burnishing machine. The burnishing process removes the top particles of the floor finish with the fine abrasive rotating disc, producing a smooth glossy appearance. In the process, the top layer of floor finish is removed in the form of a very fine powder. In addition to this powder, the burnishing pad itself wears down. This powder and worn pad material often becomes airborne because of the air turbulence created by the high speed rotation of the disc. This is undesirable because the powder, material and dust then settles back onto the floor and on furniture and must be removed with a dust mop, vacuum cleaner or similar means.

To reduce the need to dust mop after burnishing or polishing, prior floor polishing means included dust collection systems of various forms. Some prior dust collection systems utilized a separate vacuum device including a fan for creating a vacuum to pick up dirt or dust such as in U.S. Pat. No. 2,663,893. Further, many prior dust collection systems utilized the well known cyclone effect created by the rotation of the operative member inside of a housing to deliver air entrained with dirt, dust, and other debris and created by the rotation of the operative member relative to a working surface such as shown in floor maintenance devices such as in U.S. Pat. No. 1,093,820; in shoe cleaning apparatus such as in U.S. Pat. No. 2,933,752; in lawn mowers such as in U.S. Pat. No. 3,413,783; in abrading tools such as in U.S. Pat. No. 4,148,110, and the like. For example, U.S. Pat. No. 3,064,292 shows a fan attached to the drive shaft for the polishing or other floor-maintenance element for drawing dust-laden air from adjacent the floor and discharging it through a dust-collection bag. Similarly, U.S. Pat. No. 4,178,654 shows a fan which is rotated at a higher rotational speed than the polishing brush. U.S. Pat. No. 4,598,440 shows an X-pad for creating air currents and which eliminate the need for a fan. U.S. Pat. No. 4,731,956 shows an impeller integrally formed on the hub portion of the polishing member.

However, each of these collection systems is deficient in various respects in ease of manufacture and assembly, effective collection, economies, operation, and the like. For example, such collection systems interfered with the ability of the housing to deform to follow the floor surface as is utilized in many current types of floor burnishing machines and in the effective collection of dust and debris, especially around the entire periphery of the floor polishing or other maintenance element.

Thus a need has arisen for a floor polishing machine which provides dust and debris control and which overcomes the deficiencies and disadvantages of prior collection systems.

SUMMARY

The present invention solves these and other needs and problems in the field of collection systems by providing, in the preferred form, air barriers formed in the housing and extending towards the member for maintaining the floor surface which rotates creating a high pressure area rotationally upstream from the air barrier, which directs the air upstream from the air barrier out an air outlet into a filter device, and which creates a vacuum rotationally downstream from the air barrier for drawing air between the housing and the work surface and into the air stream created by the rotation of the floor surface maintenance member.

It is thus an object of the present invention to provide a novel dust collection/control system.

It is further an object of the present invention to provide such a novel dust collection/control system without requiring specially manufactured polishing pads and the like.

It is further an object of the present invention to provide such a novel dust collection/control system utilizing a vacuum chamber located concentrically of the rotating working member It is further an object of the present invention to provide such a novel dust collection/control system utilizing air currents passively generated by the rotating working member.

It is further an object of the present invention to provide such a novel dust collection/control system which allows the housing to follow the floor surface regardless of the unevenness of the floor surface and/or wear of the floor engaging skirt.

It is further an object of the present invention to provide such a novel dust collection/control system utilizing plural collection points.

It is further an object of the present invention to provide such a novel dust collection/control system which can be easily and inexpensively incorporated into a floor polishing machine.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
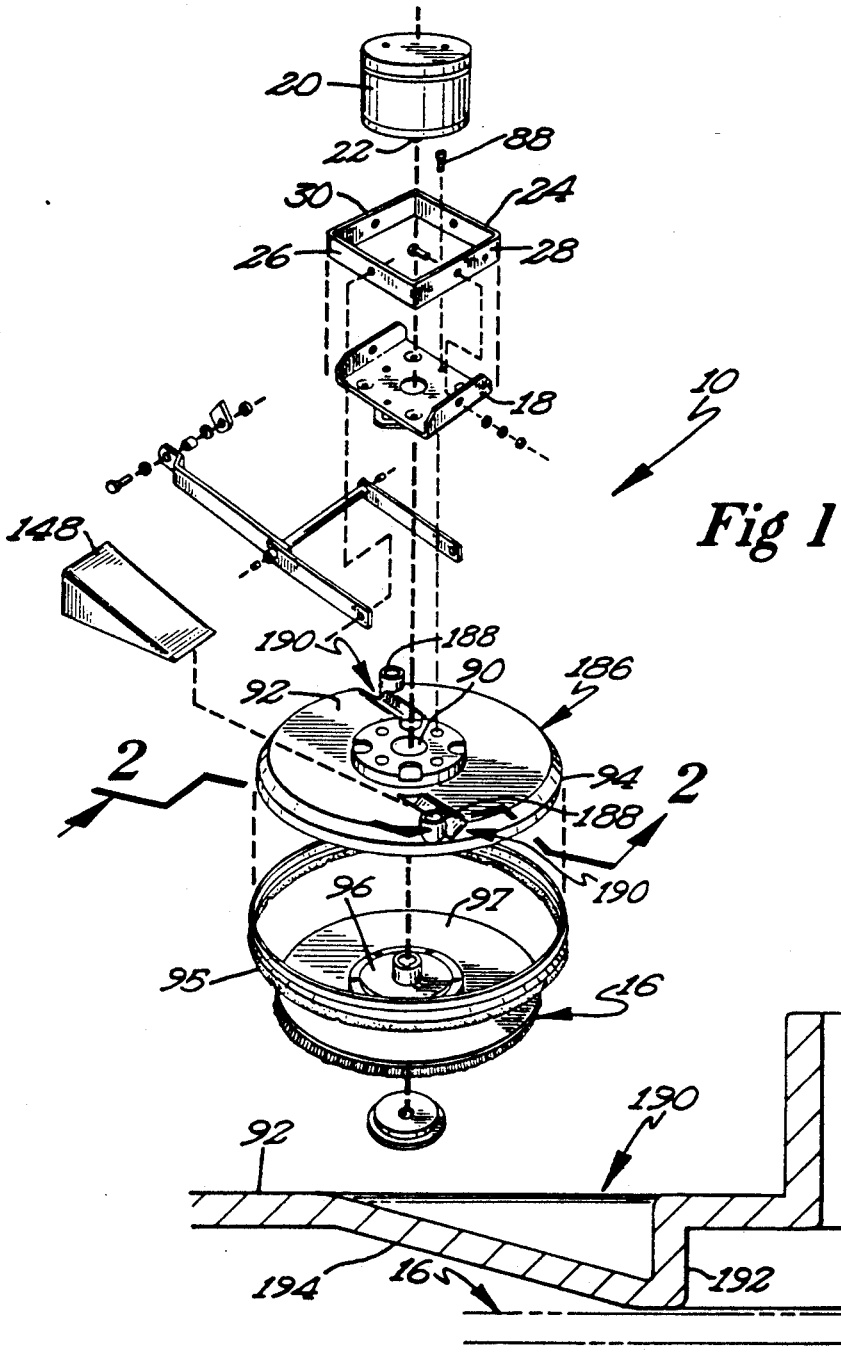
FIG. 1 shows a partial, exploded perspective view of a floor polishing machine including a dust collection/-control system according to the preferred teachings of the present invention.
Figure 2:
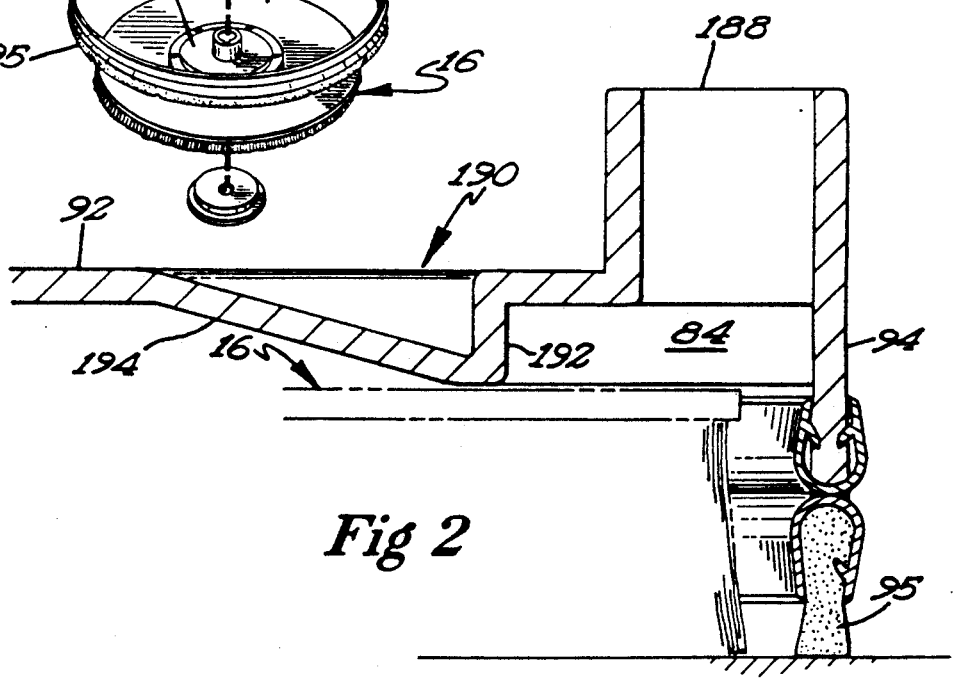
FIG. 2 shows a partial, cross-sectional view of the floor polishing machine of FIG. 1 according to section line 2—2 of FIG. 1.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "top", "bottom", "upper", "lower", "first", "second", "front", "rear", "end", "edge", "forward", "inside", "outside", and similar terms are used herein, it should be understood that these terms have reference only to the structure shown in the drawings as it would appear to a person viewing the drawings and are utilized only to facilitate describing the invention.

DESCRIPTION

A machine for maintaining a work surface is shown in the drawings in its most preferred form as a floor polishing machine according to the teachings of the present invention and is generally designated 10. Floor polishing machine 10 generally includes a chassis adapted to be moved along a floor or other cleaning surface such as by wheels. A planar polishing member 16 for polishing the floor surface when rotated about a polishing axis extending generally perpendicular to the floor and in a plane substantially parallel to the floor surface when the chassis is moved along the floor is provided in its most preferred form as a holder of the flexible type for a polishing pad, brush or the like. A platform 18 is further provided in the most preferred form for mounting a motor 20 having a vertically orientated output shaft 22 which forms the polishing axis and to which polishing member 16 is non-rotatably secured. Platform 18 in the preferred form includes an upstanding, perimeter frame including frame sides 24 and 26 and front and rear frame edges 28 and 30.

Floor polishing machine 10 further includes suitable apparatus for raising polishing member 16 relative to the floor to allow transporting machine 10 from one location to another in a non-operating mode and for lowering polishing member 16 relative to the floor to allow engagement of polishing member 16 in an operating mode. Further, floor polishing machine 10 can include provisions for allowing the placement of even cleaning pressure on the floor surface by polishing member 16 regardless of the unevenness of the floor surface. It can be realized that the raising and lowering of polishing member 16 may be performed manually or automatically. In the most preferred form, polishing member 16 is raised and lowered manually but could include the parallelogram and lift lever assembly as shown and described in U.S. Pat. No. 4,731,956 which is hereby incorporated herein by reference.

Floor polishing machine 10 according to the teachings of the present invention includes provisions for creating a vacuum chamber 84 surrounding polishing member 16 and located around and concentrically to floor polishing member 16. Specifically, a housing or shield 186 is provided secured to platform 18 by bolts 88 with shaft 22 extending through central opening 90. Specifically, shield 186 is closed for air flow therethrough and includes a generally planar portion 92 of a circular configuration in its most preferred form located on the opposite side of polishing member 16 than the floor surface. Shield 186 further includes a flange 94 extending downwardly from the periphery of planar portion 92 towards and adjacent to the floor surface and having a size complementary to but larger than polishing member 16. Flange 94 includes a flexible skirt 95 dependingly mounted therefrom. Skirt 95 is formed of a felt material and has openings cut therein to allow air to enter shield 186 around the entire periphery and/or may be formed of filter media allowing air flow therethrough. In the most preferred form, shield 186 is made from thin plastic or like material so that shield 186 can flex to follow uneven floors and adjust for shirt wear, all the while pressing skirt 95 against the floor.

First and second vertical, diametrically spaced air outlets or spouts 188 upstand from planar portion 92 adjacent to flange 94 of shield 186 and generally parallel to the polishing axis. Dust collection and filter devices 148 such as a vacuum filter bag as shown are attached to and in fluid communication with spouts 188. Just downstream from spouts 188, first and second, elongated air barriers or dams 190 are formed in the bottom face of planar portion 92. In the most preferred form, air dams 190 are formed by depressions in planar portion 92. Specifically, air dams 190 each include a first, vertically extending face 192 integrally extending generally perpendicularly from the bottom face of planar portion 92 towards but spaced from polishing member 16 and having an opposite edge. Air dams 190 further include a second face 194 integrally extending angularly between the opposite edge of face 192 and the bottom face of planar portion 92 spaced downstream from face 192. In the preferred form, face 194 extends at an angle in the order of 45° from the bottom face of planar portion 92 and of face 192. Air dams 190 extend from flange 94 generally radially towards the polishing axis of polishing member 16 and are spaced 180° from each other and diametrically arranged on planar portion 92. Additionally, air dams 190 extend from flange 94 to a point adjacent to but spaced from the diametric center and specifically, at a location spaced from motor 20 and hub portion 96. Furthermore, air dams 190 are arranged at an angle to a radial direction or a diameter, and particularly at an angle of 30°, with the free end of air dams 190 located upstream from the ends of air dams 190 at flange 94.

Polishing member 16 according to the teachings of the present invention includes a hub portion 96 for slideable receipt of shaft 22 of motor 20 and an annular disc 97 of flexible construction and forming the backing for polishing pad, brush, or the like of polishing member 16. Hub portion 96 and polishing member 16 are rotatably related to shaft 22 of motor 20 by any suitable means.

Now that the basic construction of floor polishing machine 10 according to the preferred teachings of the present invention has been explained, the operation and subtle features of the dust collection system of machine 10 can be set forth and appreciated. Specifically, as polishing member 16 rotates, which in the preferred form is in a counter-clockwise rotation from the top and at 2000 RPM, polishing member 16 passively generates an air current moving in the same direction as the rotation of polishing member 16. This air current is contained inside vacuum chamber 84 in the space between the outside diameter of polishing member 16 and flange 94 and skirt 95 and in the space between the top of polishing member 16 and planar portion 92 of shield 186. It should be noted that polishing member 16 in the preferred form does not include an impeller, fan, or other means for actively generating such air currents as in prior polishing machines.

It can then be appreciated that as the passively generated air current comes to air dam 190, a region of pressure higher than atmospheric pressure or in other words a high pressure area is created due to the decreased area between the opposite edge of face 192 and polishing member 16 than between planar portion 92 and polishing member 16 upstream of air dam 190. The high pressure air seeks to escape so it readily flows out spout 188 into bag 148, carrying with it any dust and containments. Downstream from air dam 190, a region of pressure lower than atmospheric pressure or in other words a vacuum is created as chamber 84 returns to its larger cross sectional area, drawing air in through the openings in, under, or through skirt 95.

It is noted that the problem of dirt and dust being blown away from rotating members is well known and is especially undesirable in cleaning apparatus where the air born dust settles back onto the cleaning surface or its environment where further effort is required for removal. Prior approaches have been utilized in prior cleaning and like apparatus to solve this problem; however, it is believed that a totally unique technique to solving this problem is accomplished by the present invention and is believed to be particularly advantageous. First, the present invention allows utilization of a standard circular polishing pad and the like and specifically does not require specially manufactured working members, polishing pads or the like. Further, due to the rotation of polishing member 16, powder created by the cleaning of the floor surface by polishing member 16 tends to move outwardly to the perimeter of polishing member 16. It should then be noted that vacuum chamber 84 located concentrically of polishing member 16 is particularly advantageous as the polishing member 16 tends to deliver such floor powder to the vacuum chamber 84 for expulsion under pressure through spouts 188 created by air dams 190. Furthermore according to the teachings of the present invention, the degree of vacuum in chamber 84 may be easily varied by adjusting openings in skirt 95.

According to the preferred teachings of the present invention, a plurality of air dams 190 and spouts 188 are provided equally circumferentially spaced from each other to thus provide multiple collection points around the periphery rather than a single collection point. It has been found that multiple collection points dramatically increase the amount of material collected and specifically in the order of four times more. It should be noted that the vacuum created in any particular polishing means is a function of air speed within the shield and the size of air dams 190. Major factors for air speed are the rotational speed and size of the polishing member and the manner of generation of the air stream such as passively or by the active generation such as by the use of fans. Especially for passive systems or systems with generation means rotating at the same speed as the polishing member, the vacuum produced may be insufficient in single collection point systems to produce an indraft around the entire periphery and in fact in some portions of the periphery, air may even be pushed outwardly through the skirt. Multiple collection points as in the present invention allow the creation of multiple vacuum locations which are responsible for producing indrafts of air around respective portions of the periphery less than the entire 360° periphery and intermediate the collection points and specifically no single collection point is responsible for producing indrafts of air around the entire periphery as in prior single collection point systems Furthermore, the indraft of air is more uniform with multiple collection points than with single point systems where the indraft of air decreases with the circumferential spacing from the collection point. Thus, the efficiency of the dust collection system is enhanced, as each collection point can collect dust more effectively over the portion of the periphery than over the entire periphery.

It can then be appreciated that the particular configuration of air dams 190 is believed to be particularly advantageous. Specifically, the angular relationship of air dams 190 to the radial direction biases the air current towards the periphery and spouts 188. Further, the decreasing zone in cross-sectional area between flange 94 and air dam 190 as the air travels toward spout 188 biases the flow of air out of shield 186 through spouts 188. Furthermore, the perpendicular arrangement of face 192 to planar portion 92, polishing member 16, and the air currents passively generated thereby, maximizes the height of face 192 in the air stream to create the pressure differential required for operation as well as creates a surface against which dust and other containments move. Furthermore, faces 194 allow dams 190 to be easily manufactured by molding Also, air dams 190 according to the preferred teachings of the present invention are also advantageous in allowing shield 186 to flex. Particularly, in the most preferred form, shield 186 can be formed of thin plastic and is flexible to allow shield 186 to deform to contact skirt 95 with the floor around its entire circumference as skirt 95 wears or if the floor surface is uneven, and to press skirt 95 against the floor. Prior to the present invention, one way of enhancing the creation of the air current is through the use of a containment housing for the polishing or floor-maintenance element with an increasing volume up to the collection point such as by a channel which enlarges along the periphery of the housing Specifically, U.S. Pat. No. 1,093,820 shows an eccentrically disposed boss of a circular casing creating a channel extending around substantially all of the periphery and open to the interior of the housing and of a gradually increasing thickness to provide a gradually larger zone in cross-sectional area, with the air discharge nozzle in communication with the channel at its point of greatest cross-sectional area. The major disadvantage of the channel arranged outside of the periphery of the polishing or floor-maintenance element is the increased lateral sizing of the housing. To overcome this disadvantage, others have arranged the channel on the upper part of the housing such as in U.S. Pat. No. 4,178,654 as was well known in collection systems such as in lawn mowers as shown in U.S. Pat. Nos. 2,957,295; 3,049,853; 3,157,015; 3,413,783; 3,453,812; and 3,568,421 which similarly have a rotating maintenance element located in a housing which directs air and containments arising from the rotation of the maintenance element into a filter bag. It can then be recognized that the use of channels extending on the upper part and around a major portion of the periphery of the housing would be particularly disadvantageous in the use of flexible shields. Specifically, the bends required to form such channels would give shields further structural strength which adversely affect their ability to deform to engage the skirt with the floor surface. Thus, such channels would destroy the flexibility required for such shields to deform as the skirt wears or if the floor surface is uneven.

Air dams 190 according to the teachings of the present invention do not negatively impact on the flexibility of shield 186. Specifically, the bends forming faces 192 and 194 of air dams 190 are generally arranged radially on planar portion 92 and are spaced radially inward from and on diametrically opposite sides of the center of planar portion 92. Thus, although the bends forming air dams 190 do increase the structural strength of planar portion 92 at those locations, this increased structural strength does not prevent planar portion 92 from flexing from side-to-side generally about an axis defined by air dams 190, from flexing upwardly or downwardly radially inward of air dams 190 and specifically between the inner ends of air dams 190 and the central portion, and/or from deforming at locations intermediate air dams 190. It can then be appreciated that air dams 190 do not adversely affect the flexibility of shield 186 as would occur if an upper channel extending a major portion of the periphery of the housing of the type of U.S. Pat. No. 4,178,654 were utilized or would occur even if an upper chute extending substantially less than one-half of the periphery of the housing of the type of U.S. Pat. No. 4,731,956 were utilized and do not increase the lateral sizing of the housing as would occur if an eccentrically disposed channel such as U.S. Pat. No. 1,093,820 were utilized Now that the basic teachings of the present invention have been explained, many extensions and variations will be obvious to one having ordinary skill in the art. For example, although in the preferred embodiment according to the teachings of the present invention the utility of the dust collection/control system has been illustrated in connection with a floor polishing machine, it can be appreciated that the system of the present invention has application in other fields where collection/control of debris is desired Further, although floor polishing member 16 is shown as being rotated by a battery powered motor, polishing member 16 may be rotated by other means including a motor powered by outlet current or by an internal combustion engine.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. In a machine for maintaining a work surface including a planar member for rotation about an axis generally perpendicular to the work surface in a plane substantially parallel to the work surface and a housing including a planar portion located on the opposite side of the planar member than the work surface and having a periphery, with the housing further including a flange extending form the periphery of the planar member towards and adjacent to the work surface, with the planar member located within the planar portion and flange of the housing, an improved collection system comprising, in combination: a plurality of air barriers extending from the planar portion of the housing towards bu spaced from the planar member, with the air barriers being circumferentially spaced from each other and extending from the periphery of the planar portion towards the axis of the planar member; and an air outlet associated with each air barrier and extending from the housing adjacent the periphery of the planar portion and the air barrier, with the air outlet positioned on the side of the air barrier opposite to the direction of rotation of the planar member.

2. The collection system of claim 1 wherein the air barriers extend from the periphery of the planar portion generally radially towards the axis of the planar member.

3. The collection system of claim 2 wherein the air barriers extend generally at an upstream angle in the order of 30° from a radial direction towards the axis of the planar member.

4. The collection system of claim 3 wherein the air outlet extends in a direction parallel to the axis of the planar member.

5. The collection system of claim 4 further comprising, in combination: a collection and filter device attached to and in fluid communication with each air outlet.

6. The collection system of claim 5 wherein each air barrier comprises a first face extending generally perpendicularly from the planar portion.

7. The collection system of claim 6 wherein the first face terminates in an edge opposite to the planar portion; and wherein each air barrier further comprises a second face extending angularly between the edge of the first face and the planar portion spaced from the first face.

8. The collection system of claim 7 wherein each air barrier is integrally formed with the planar portion.

9. The collection system of claim 8 wherein the planar portion is flexible to allow the housing to deform engaging the flange with the work surface.

10. The collection system of claim 9 wherein each air barrier terminates radially inward from the center of the planar portion to allow the planar portion to deform radially inward of the air barrier.

11. The collection system of claim 1 wherein the air barriers are equally circumferentially spaced from each other.

12. The collection system of claim 11 wherein the plurality of air barriers includes a first air barrier and a second air barrier, with the first and second air barriers being spaced 180° from each other.

13. The collection system of claim 1 wherein the plurality of air barriers includes a first air barrier and a second air barrier.

14. The collection system of claim 1 further comprising, in combination: a collection and filter device attached to and in fluid communication with each air outlet.

15. The collection system of claim 14 wherein the air outlet extends in a direction parallel to the axis of the planar member.

16. The collection system of claim 1 wherein each air barrier comprises a first face extending generally perpendicularly from the planar portion.

17. The collection system of claim 16 wherein the first face terminates in an edge opposite to the planar portion; and wherein each air barrier further comprises a second face extending angularly between the edge of the first face and the planar portion spaced from the first face.

18. The collection system of claim 17 wherein each air barrier is integrally formed with the planar portion.

19. The collection system of claim 1 wherein the planar portion is flexible to allow the housing to deform engaging the flange with the work surface.

20. The collection system of claim 1 wherein the housing further includes means for allowing air to enter beneath and around the entire periphery of the flange adjacent to the work surface.

* * * * *

UNITED STATES PATENT AND TRADEMARK OFFICE

CERTIFICATE OF CORRECTION

PATENT NO. : 5,088,151

DATED : February 18, 1992

INVENTOR(S) : Donald J. Legatt

It is certified that error appears in the above-identified patent and that said Letters Patent is hereby corrected as shown below:

Column 2, line 26, after "member" add --.--.

Column 5, line 66, after "systems" insert --.--.

Column 6, line 21, after "molding" add --.--.

Column 6, line 35, after "housing" insert --.--.

Column 7, line 22, after "utilized" add --.--.

Column 7, line 32, after "desired" add --.--.

Column 7, line 56, cancel "form" and substitute therefor --from--.

Column 7, line 62, cancel "bu" and substitute therefor --but--.

Signed and Sealed this

Fourth Day of May, 1993

*Attest:*

*Attesting Officer*

Michael K. Kirk

MICHAEL K. KIRK

*Acting Commissioner of Patents and Trademarks*